US007789074B2

(12) United States Patent
Tashima

(10) Patent No.: US 7,789,074 B2
(45) Date of Patent: Sep. 7, 2010

(54) FUEL SUPPLY SYSTEM FOR INTERNAL COMBUSTION ENGINE

(75) Inventor: Kazuchika Tashima, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 63 days.

(21) Appl. No.: 12/209,390

(22) Filed: Sep. 12, 2008

(65) Prior Publication Data

US 2009/0078237 A1 Mar. 26, 2009

(30) Foreign Application Priority Data

Sep. 21, 2007 (JP) ..... 2007-245617

(51) Int. Cl.
*F02M 37/10* (2006.01)
*F02M 37/00* (2006.01)

(52) U.S. Cl. ..... 123/514; 123/516

(58) Field of Classification Search ..... 123/514, 123/456, 447, 468, 469, 497, 516, 179.17
See application file for complete search history.

(56) References Cited

U.S. PATENT DOCUMENTS 5,740,784 A * 4/1998 McKinney ..... 123/509
6,021,763 A * 2/2000 Yoshihara et al. ..... 123/516
6,615,807 B2 * 9/2003 Rembold et al. ..... 123/516
2002/0124834 A1 * 9/2002 Rembold et al. ..... 123/514

FOREIGN PATENT DOCUMENTS

| | | |
|---|---|---|
| JP | 59-46360 | 3/1984 |
| JP | 60-53640 | 3/1985 |
| JP | 3-108853 | 11/1991 |
| JP | 5-59976 | 3/1993 |
| JP | 8-200176 | 8/1996 |
| JP | 8-270520 | 10/1996 |
| JP | 2005-42649 | 2/2005 |

* cited by examiner

*Primary Examiner*—Mahmoud Gimie
(74) *Attorney, Agent, or Firm*—Oblon, Spivak, McClelland, Maier & Neustadt, L.L.P.

(57) ABSTRACT

A high-pressure return passage returns excess fuel in a delivery pipe that is connected to an injector to a fuel tank. An upstream end of the high-pressure return passage is connected to the delivery pipe via a high-pressure regulator. A vertically lower portion of the high-pressure return passage is vertically below the upstream end and the downstream end. A low-pressure return passage returns excess fuel in a main passage to the fuel tank. The switch valve switches the open state and the closed state of the low-pressure return passage. A control section controls the switch valve to the closed state after the engine is stopped and drives the fuel pump so as to execute a forced return process that flows fuel into the high-pressure return passage.

8 Claims, 5 Drawing Sheets

FUEL SUPPLY SYSTEM FOR INTERNAL COMBUSTION ENGINE

BACKGROUND OF THE INVENTION

The present invention relates to a fuel supply system for an internal combustion engine. The fuel supply system switches a fuel supplying path to an engine so as to switch fuel injection pressure to the engine.

Recent fuel supplying apparatuses are required to supply greater amount of fuel to a combustion chamber to deal with the demands for increased power of engines and the use of alcohol-containing fuel. The stoichiometric air-fuel ratio of the alcohol-containing fuel is smaller than the stoichiometric air-fuel ratio of gasoline. The injection amount of fuel from an injector is changed based on an open period of the injector and fuel injection pressure. The fuel injection pressure is fuel pressure in a delivery pipe that supplies fuel to the injector. In basic control for controlling the fuel injection amount, the open period of the injector is controlled. However, in case of intake stroke injection, a maximum value of the open period of the injector is limited by the period of the intake stroke. In the intake stroke injection, air-fuel mixture is generated by injecting fuel from the injector during the intake stroke. This inevitably limits the open period of the injector. Therefore, it is difficult to supply a great amount of fuel to the combustion chamber only by extending the open period of the injector.

As the fuel injection pressure is set to be higher, the fuel injection amount per unit time is increased. Therefore, it is predicted that the fuel injection amount can be greatly increased in the intake stroke injection.

However, in an actual operation, if the fuel injection pressure is set to be high, the change amount of the fuel injection amount with respect to the change of the open period of the injector is increased. Therefore, precise control of the fuel injection amount may be difficult only by setting the fuel injection pressure to be high. This is because there is a limit to reduction of the change amount of the open period of the injector. That is, control resolution of the injector cannot be set to be smaller than a predetermined value. For example, Japanese Laid-Open Patent Publication No. 5-59976 discloses a high-pressure return passage and a low-pressure return passage that return excess fuel from the delivery pipe to the fuel tank. The high-pressure return passage has a high-pressure regulator and the low-pressure return passage has a low-pressure regulator.

SUMMARY OF THE INVENTION

Accordingly, an objective of the present invention is to provide an improved fuel supply system.

One aspect of the present invention provides a fuel supply system for supplying fuel to an internal combustion engine. The fuel supply system comprises a fuel tank. A delivery pipe is connected to an injector that injects fuel to the engine. A main passage extends to the delivery pipe from the fuel tank. A fuel pump is provided on the main passage and pressurizes and sends the fuel in the fuel tank to the delivery pipe. A high-pressure return passage returns excess fuel in the delivery pipe to the fuel tank. A high-pressure regulator opens the high-pressure return passage when fuel injection pressure in the delivery pipe is a high-pressure threshold value or higher. The high-pressure return passage has an upstream end, a downstream end, and a vertically lower portion. The upstream end is connected to the delivery pipe via the high-pressure regulator. The downstream end is connected to the fuel tank. The vertically lower portion is vertically below from the upstream end and the downstream end. A low-pressure return passage returns excess fuel in the main passage to the fuel tank. The low-pressure return passage is connected to the main passage. A low-pressure regulator opens the low-pressure return passage when the fuel injection pressure is a low-pressure threshold value or higher. The low-pressure threshold value is lower than the high-pressure threshold value. A switch valve switches an open state and a closed state of the low-pressure return passage. A control section controls the fuel pump. The control section controls the fuel injection pressure by switching the open state and the closed state of the switch valve based on a running state of the engine. The control section switches the switch valve to the closed state after the engine is stopped and drives the fuel pump so as to execute a forced return process that causes the fuel to flow into the high-pressure return passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF THE PREFERRED EMBODIMENT

FIGS. 1A to 4 show a fuel supply system according to one embodiment of the present invention. The fuel supply system supplies fuel to an internal combustion engine. The engine of the present embodiment is a V-type eight-cylinder engine that is mounted to a flexible-fuel vehicle. The fuel for the flexible-fuel vehicle may be gasoline or alcohol-containing fuel that is obtained by mixing gasoline and ethanol at a predetermined mixture ratio.

Figure 1A:
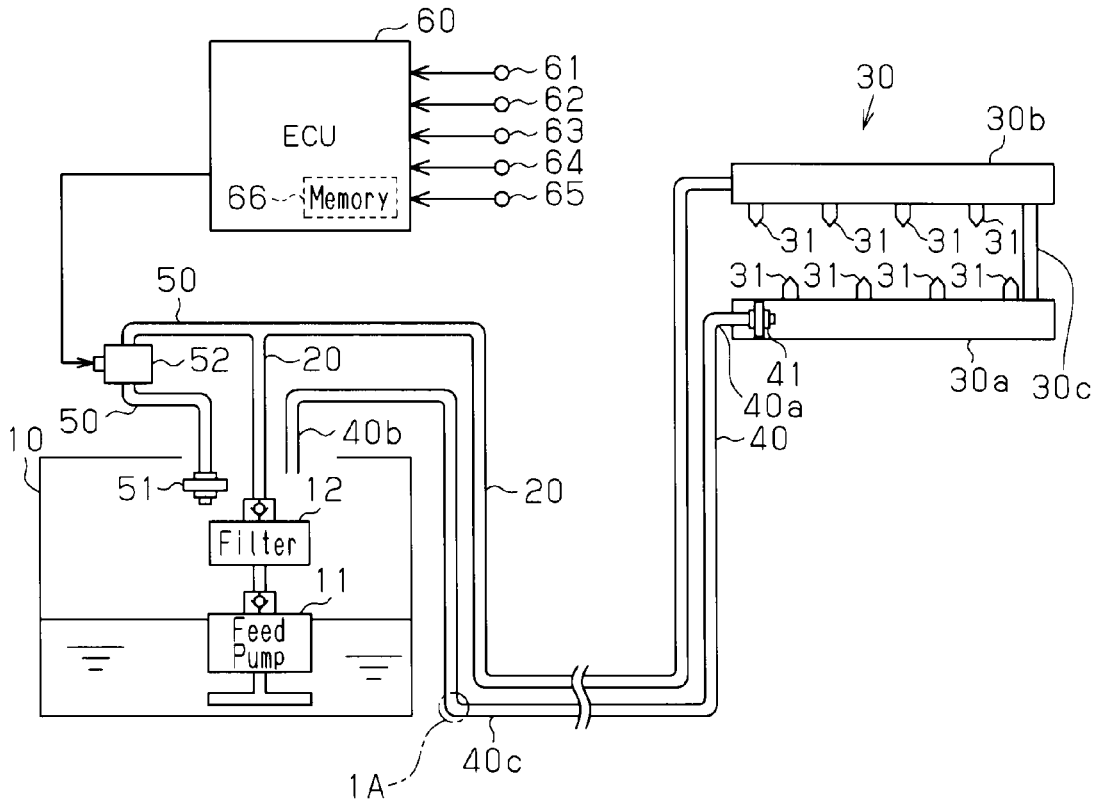
FIG. 1A is a block diagram of a fuel supply system according to one embodiment of the present invention.

A delivery pipe 30 that is arranged in a front portion of a vehicle is shown in a right portion of FIG. 1A. The delivery pipe 30 has eight injectors 31. The injectors 31 inject fuel to an engine that is mounted in an engine compartment of the vehicle.

A fuel tank 10 that is arranged in a rear portion of the vehicle is shown in a left portion of FIG. 1A. A main passage 20 extends from the fuel tank 10 to the delivery pipe 30. An electric feed pump 11 is arranged in the fuel tank 10. The feed pump 11 is a fuel pump that pressurizes and sends fuel from the fuel tank 10 to the delivery pipe 30. An electric control unit (ECU) 60 applies a rated voltage to the feed pump 11 while the engine is operated. As a result, the feed pump 11 continuously discharges a constant amount of fuel to the delivery pipe 30 at a constant pressure per unit time. A filter 12 is provided at a portion in the main passage 20 between the feed pump 11 and the delivery pipe 30. The filter 12 removes fine foreign matters contained in the fuel.

The delivery pipe 30 is formed in a substantially U-shape and has a right pipe 30*a*, a left pipe 30*b*, and a connection pipe 30*c*. The connection pipe 30*c* connects the right pipe 30*a* and the left pipe 30*b*. The right pipe 30*a* has four injectors 31 that supply fuel to the four cylinders in a right bank of the engine. The left pipe 30*b* has four injectors 31 that supply fuel to the four cylinders in a left bank of the engine.

The main passage 20 is connected to the left pipe 30*b*. An upstream end 40*a* of a high-pressure return passage 40 is connected to the right pipe 30*a* via a high-pressure regulator 41. A downstream end 40*b* of the high-pressure return passage 40 is arranged in the fuel tank 10.

The high-pressure regulator 41 opens if the fuel injection pressure is a high-pressure threshold value P1 or higher. The fuel injection pressure is fuel pressure in the delivery pipe 30. If the fuel injection pressure is the high-pressure threshold value P1 or higher, the excess fuel in the delivery pipe 30 returns to the fuel tank 10 via the high-pressure return passage 40.

A low-pressure return passage 50 is connected to a portion in the main passage 20 between the filter 12 and the delivery pipe 30. The low-pressure return passage 50 extends to the fuel tank 10. A low-pressure regulator 51 is provided in the low-pressure return passage 50. The low-pressure regulator 51 opens if the fuel pressure in the low-pressure return passage 50 is a low-pressure threshold value P2 or higher. The low-pressure threshold value P2 is set to be lower than the high-pressure threshold value P1. The high-pressure threshold value corresponds to a first predetermined pressure and the low-pressure threshold value P2 corresponds to a second predetermined pressure. The high-pressure regulator 41 corresponds to a first pressure regulator and the low-pressure regulator 51 corresponds to a second pressure regulator. Therefore, if the fuel injection pressure is the low-pressure threshold value P2 or higher, the excess fuel in the delivery pipe 30 returns to the fuel tank 10 via the low-pressure return passage 50.

A switch valve 52 is provided in the low-pressure return passage 50. The switch valve 52 is a normally open solenoid valve, and closes the low-pressure return passage 50 when voltage is applied thereto.

The ECU 60 is a control section that controls an operating state of the engine in an integrated manner. The ECU 60 controls the switch valve 52. The ECU 60 is connected to a main switch 61 that is operated by a driver. The ECU 60 starts the engine when the main switch 61 is turned on and stops the engine when the main switch 61 is turned off. The ECU 60 is connected to an accelerator pedal position sensor 62 that detects an accelerator pedal depressed amount TA, a crank angle sensor 63 that detects an engine rotating speed NE, an air flowmeter 64 that detects an intake air amount GA, and a water temperature sensor 65 that detects an engine coolant temperature THW. Signals are input to the ECU 60 from the sensors and switches. The ECU 60 executes various types of calculation based on the signals and controls the engine. The ECU 60 has a memory 66 for storing various calculation results.

The ECU 60 estimates an engine temperature TQ based on the engine coolant temperature THW and the intake air amount GA that represent the engine operating state. The engine temperature TQ represents an amount of engine combustion heat. The intake air amount GA is correlated to the fuel injection amount.

The stoichiometric air-fuel ratio of the alcohol-containing fuel is smaller than the stoichiometric air-fuel ratio of gasoline. When alcohol-containing fuel is used, a greater amount of fuel is required to be injected to the engine combustion chamber compared to a case where gasoline is used as fuel. The fuel amount that is injected from the injector 31 is changed based on the open period of the injector 31 and the fuel injection pressure in the delivery pipe 30 that is connected to the injector 31. The ECU 60 switches the switch valve 52 between an open state and a closed state based on the engine operating state so as to control the fuel injection pressure.

The ECU 60 closes the switch valve 52 when detecting the engine operating range where a large amount of fuel is required to be injected, for example, when the engine is operated under a large load or the engine is started from a cold state. As a result, the fuel injection pressure in the delivery pipe 30 is maintained to be a relatively high value by the high-pressure regulator 41. That is, each injector 31 injects a large amount of fuel in one intake stroke.

On the other hand, the ECU 60 opens the switch valve 52 in a normal engine operating state. As a result, the fuel injection pressure in the delivery pipe 30 is maintained to be a relatively small value by the low-pressure regulator 51. That is, the ECU 60 controls the fuel injection pressure to be low and executes a fine fuel injection amount control.

When the switch valve 52 is in an open state, the excess fuel in the delivery pipe 30 returns to the fuel tank 10 via the low-pressure return passage 50. That is, the fuel does not flow to the high-pressure return passage 40. Therefore, when the engine is continuously driven under a low load for a long time, that is, when the fuel injection pressure is continuously maintained to be low for a long time, the residual fuel remaining in the high-pressure return passage 40 evaporates and air in the fuel tank 10 enters the high-pressure return passage 40. If the high-pressure return passage 40 is cooled down while the engine is stopped, moisture contained in the entered air is condensed. This may generate water drops in the high-pressure return passage 40.

An upstream end 40*a* is connected to the delivery pipe 30 in the front portion of the vehicle, and a downstream end 40*b* is connected to the fuel tank 10 in the rear portion of the vehicle. The high-pressure return passage 40 extends from the upstream end 40*a* to the downstream end 40*b*. Therefore, the high-pressure return passage 40 has a storing portion 40*c* that passes through a portion under a floor of a passenger compartment. The storing portion 40*c* is a vertically lower portion that is vertically below the upstream end 40*a* and the downstream end 40*b*. The water drops generated in the high-pressure return passage 40 are stored in the storing portion 40*c*. Thus, the fuel pipe including the high-pressure return passage 40 and the main passage 20 may have the storing portion 40*c* for an appropriate layout of the vehicle.

Figure 1B:
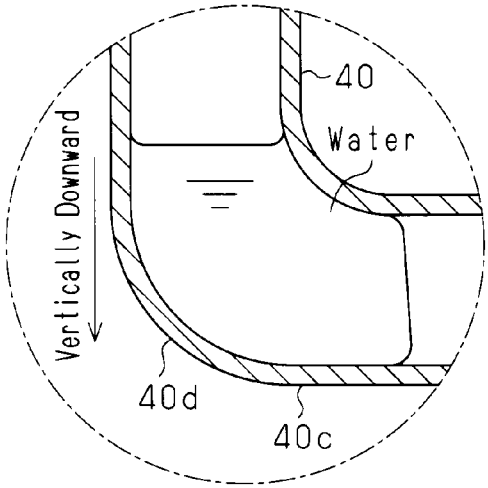
FIG. 1B is an enlarged cross-sectional view showing a storing portion of FIG. 1A.

FIG. 1B shows an enlarged cross-sectional view of an elbow portion 40*d* that is a curved portion of the storing portion 40*c*. The elbow portion 40*d* is a curved portion where the high-pressure return passage 40 vertically extends and is curved so as to horizontally extend. The water drops generated in a portion of the high-pressure return passage 40 that vertically extends flow along a passage wall and are likely to be stored in the elbow portion 40*d*.

The condensed water stored in the storing portion 40*c* may be frozen, for example when the engine is stopped. In other words, the condensed water closes the high-pressure return passage 40. Then, if the switch valve 52 is closed when the engine is started, the condensed water prevents the fuel from flowing in the high-pressure return passage 40. This may excessively increase the fuel injection pressure.

Figure 5:
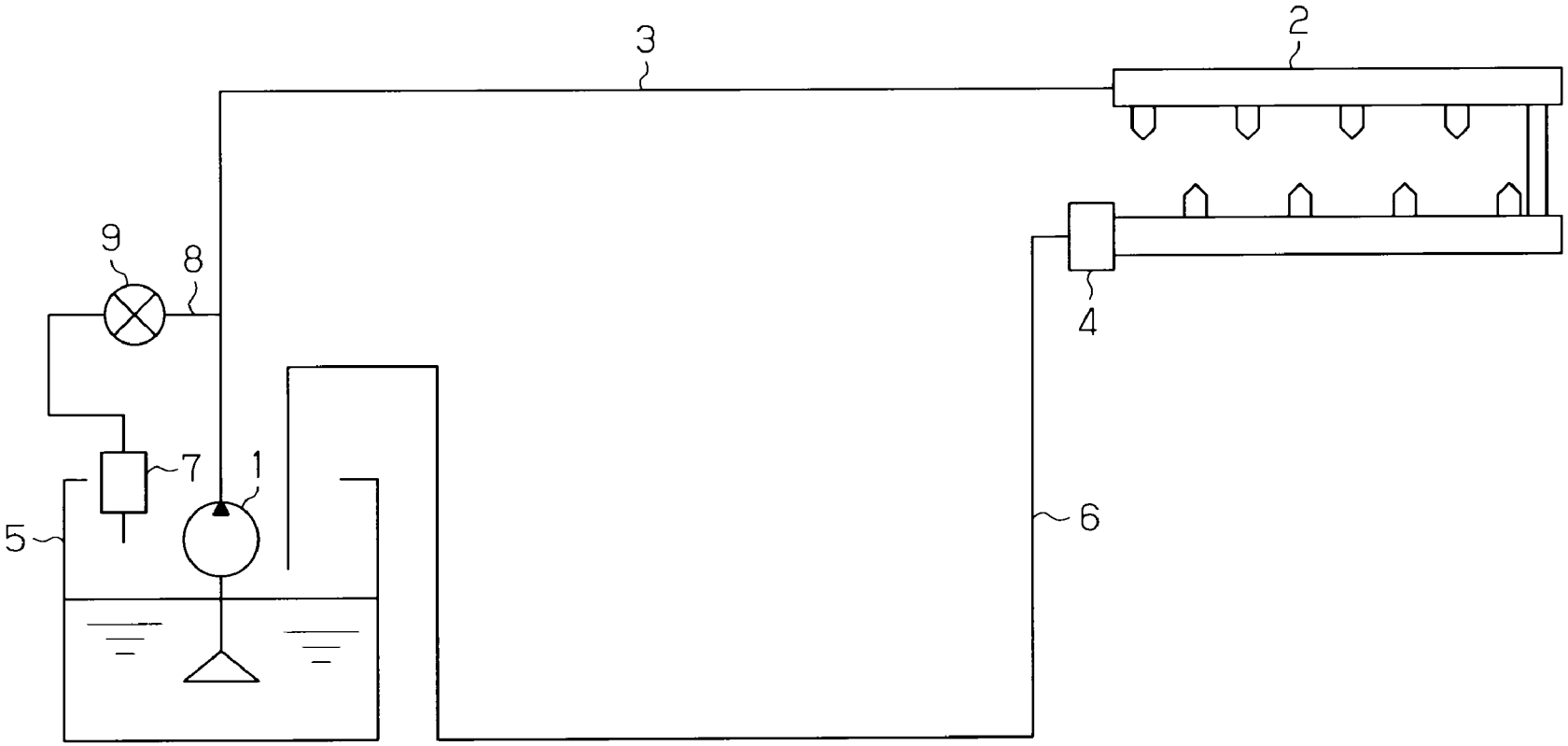
FIG. 5 is a schematic block diagram of a configuration other than the ECU of FIG. 1A.

This phenomenon also occurs in the fuel supply system shown in FIG. 5. FIG. 5 shows the fuel supply system of FIG. 1A in a simplified manner. A fuel pump 1 shown in FIG. 5 pressurizes and sends fuel from a fuel tank 5 to a delivery pipe 2 via a main passage 3. The delivery pipe 2 is connected to a high-pressure return passage 6 via a high-pressure regulator 4. A low-pressure return passage 8 that is branched from the main passage 3 has a low-pressure regulator 7 and a switch valve 9.

Figure 2:
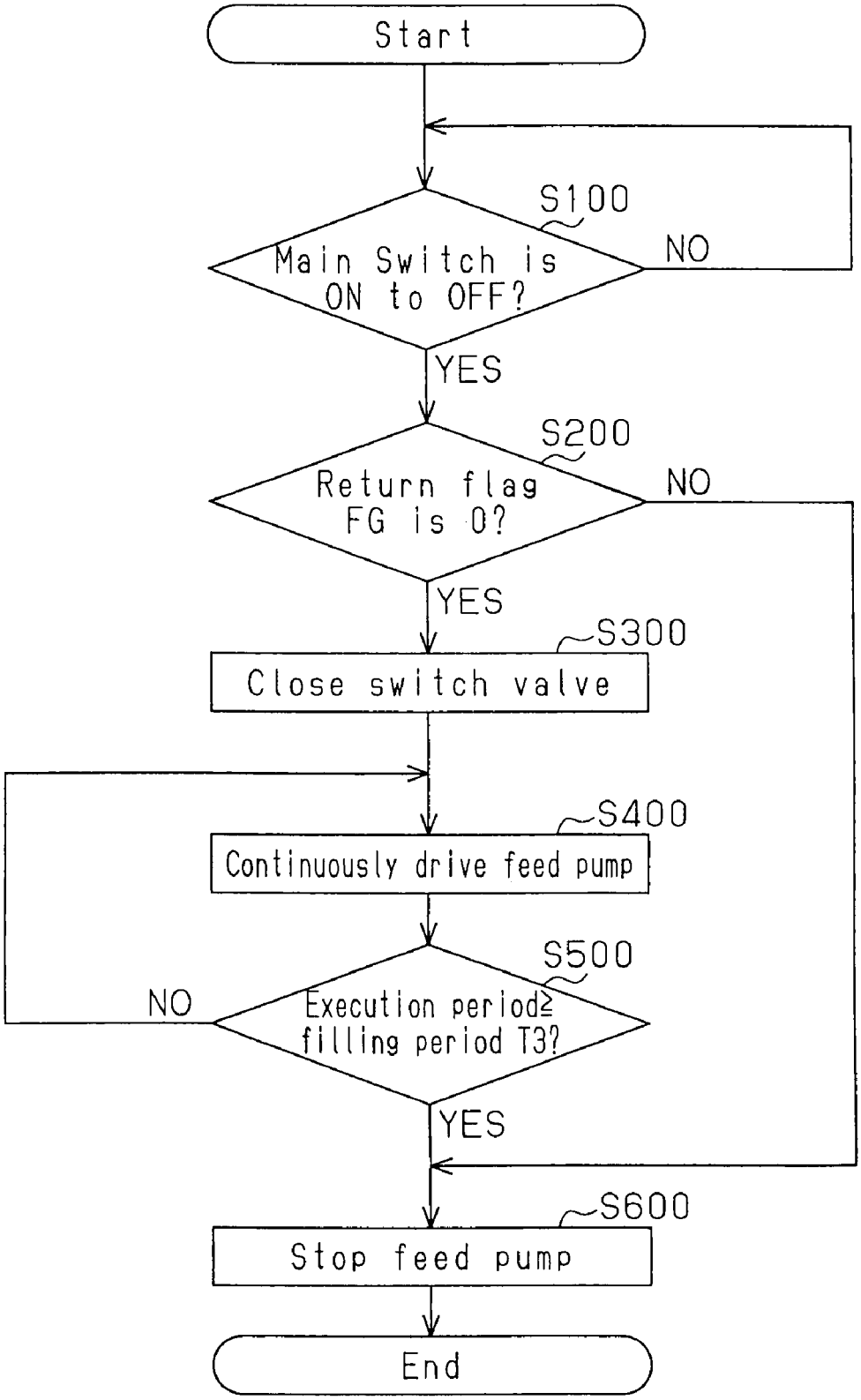
FIG. 2 is a flowchart of a forced return process that is executed by an ECU of FIG. 1A.

The ECU 60 of the present embodiment executes a forced return process shown in FIG. 2. In the forced return process, air is suppressed from entering the high-pressure return passage 40 and generation of condensed water is suppressed. Further, in the forced return process, the condensed water stored in the high-pressure return passage 40 is pushed out.

FIG. 2 shows a flowchart showing steps S100 to S600 of the forced return process. The ECU 60 executes the forced return process while the engine is running.

In step S100, the ECU 60 determines whether the main switch 61 is switched from ON to OFF. That is, the ECU 60 determines whether a driver operates to stop the engine.

If the main switch 61 is switched from ON to OFF, that is if the determination in step S100 is affirmative, the ECU 60 proceeds to step S200 while continuously driving the feed pump 11. Specifically, the ECU 60 stops functions that are required for driving the engine other than the feed pump 11, thereby stopping the engine and continuously driving the feed pump 11.

On the other hand, if the main switch 61 is ON, that is, when the determination in step S100 is negative, the ECU 60 continuously drives the engine and continuously drives the feed pump 11. The ECU 60 repeats the process of step S100 for a repeated period.

In step S200, the ECU 60 determines whether the return flag FG is "0". If the return flag FG is "0", the ECU 60 executes the forced return process of steps S300 to S500. If the return flag FG is "1", the ECU 60 does not execute the forced return process. The value "1" represents a first state value, and the value "0" represents a second state value. The return flag FG is set based on an operation history of the switch valve 52 and the engine temperature TQ. The ECU 60 of step S200 is a determining section that determines whether the return flag FG is "0" to determine whether the residual fuel remains in the high-pressure return passage 40. A memory 66 stores the return flag FG that is an information value.

The ECU 60 sets the return flag FG to "0" at an initial state of the engine. The initial state of the engine represents a state immediately after the engine is started and a state immediately after the main switch 61 is turned ON and electric power starts being supplied to the ECU 60.

Basically, the ECU 60 sets the return flag FG to "1" when the switch valve 52 is closed while the engine is running and the feed pump 11 is continuously driven for a pressure-increasing period T1 or longer. The pressure-increasing period T1 is set such that the fuel injection pressure in the delivery pipe 30 can be increased from a low-pressure threshold value P2 to a high-pressure threshold value P1 if the switch valve 52 is continuously closed for the pressure-increasing period T1. In other words, the pressure-increasing period T is set such that the excess fuel in the delivery pipe 30 can enter the high-pressure return passage 40.

On the other hand, the ECU 60 sets the return flag FG to "0" if the switch valve 52 is continuously opened for an evaporation period T2 or longer. In other words, the ECU 60 sets the return flag to "0" if a state in which the fuel in the delivery pipe 30 does not enter the high-pressure return passage 40 is continued for the evaporation period T2 or longer. The evaporation period T2 is set such that the ECU 60 can determine that the residual fuel in the high-pressure return passage 40 has evaporated by the engine temperature TQ. In other words, if the switch valve 52 is continuously opened for the evaporation period T2 while the engine is running, the ECU 60 determines that all the residual fuel in the high-pressure return passage 40 has evaporated.

Further, the ECU 60 sets the return flag FG to "0" if the engine temperature TQ is a high-temperature threshold value X or higher even if the switch valve 52 is closed. That is, the ECU 60 sets the return flag FG to "0" if the engine temperature TQ is high regardless of the operation history of the switch valve 52. This is referred to "reset" of the return flag FG. The high-temperature threshold value X is set such that the ECU 60 can determine that the residual fuel in the high-pressure return passage 40 completely evaporates in a quite short time if the engine temperature TQ reaches the high-temperature threshold value X or higher.

Figure 3:
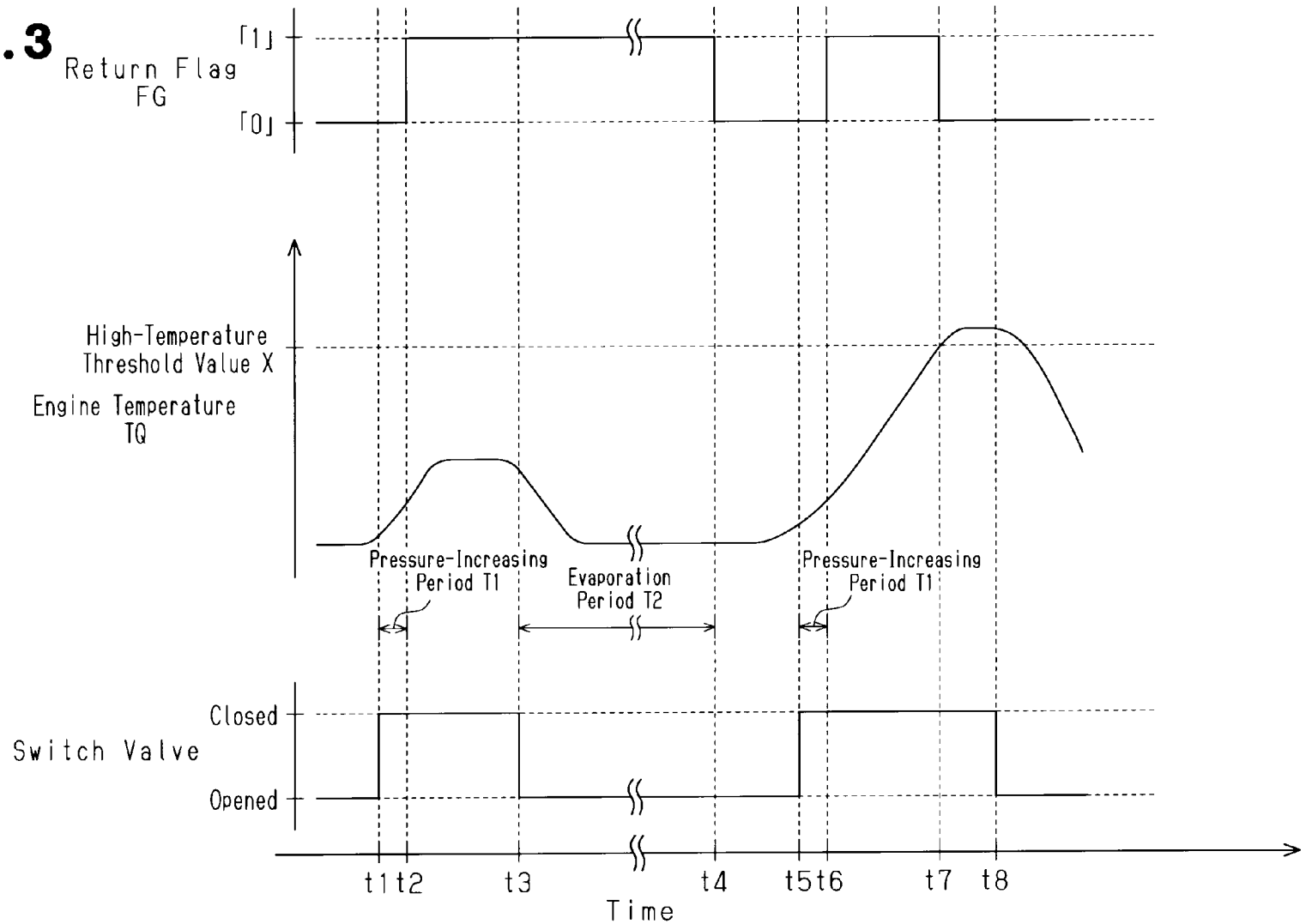
FIG. 3 is a timing chart for setting a return flag, showing relationship between a return flag, an engine temperature, and a switch valve.

FIG. 3 shows a timing chart of the return flag FG, the engine temperature TQ, and the switch valve 52. The timing chart of FIG. 3 is used for setting the return flag FG.

At time point t1, the engine is in the initial state. The return flag FG is "0" and the engine temperature TQ is a minimum value. At time point t1, the ECU 60 switches the switch valve 52 from the open state to the closed state. This increases the engine temperature TQ.

At time point t2, the ECU 60 sets the return flag FG from "0" to "1" when determining that the pressure-increasing period T1 has passed from time point t1.

At time point t3, the ECU 60 determines that the engine is in a normal running state from the initial state and opens the switch valve 52.

At time point t4, the ECU 60 sets the return flag "1" to "0" when determining that the evaporation period T2 has passed from time point t3.

At time point t5, the ECU 60 closes the switch valve 52 so as to drive the engine under high load.

At time point t6, the ECU 60 determines that the pressure-increasing period T1 has passed and sets the return flag to "1".

At time point t7, if the ECU 60 determines that the engine temperature TQ has become the high-temperature threshold value X or higher, the ECU 60 sets the return flag FG to "0" even if the switch valve 52 is closed.

At time point t8, the ECU 60 opens the switch valve 52. The return flag FG is maintained to be "0".

In step S200, the ECU 60 determines whether the return flag FG is "0". That is, the ECU 60 estimates whether the residual fuel remains in the high-pressure return passage 40 when the engine is stopped.

If the determination of step S200 is affirmative, the ECU 60 determines that no residual fuel is in the high-pressure return passage 40 when the engine is stopped. In this case, the ECU 60 executes the forced return process. In other words, the ECU 60 closes the switch valve 52 in step S300 and continuously drives the feed pump 11 in step S400. The ECU 60 continuously drives the feed pump 11 after the engine is stopped so as to execute the forced return process.

In step S500, the ECU 60 determines whether time has reached a filling period T3 after the main switch 61 is turned OFF from the ON. In other words, the execution period of the forced return process has reached the filling period T3.

The accumulated value of the discharged amount from the feed pump 11 increases in proportion to the driving time of the feed pump 11. A rated voltage is applied to the feed pump 11 so as to discharge a constant amount of fuel with a constant pressure per unit time. The filling period T3 is set such that the fuel amount flowing to the high-pressure return passage 40 from the delivery pipe 30 is the high-pressure return passage volume V0 or more. The high-pressure return passage volume V0 is a volume of the high-pressure return passage 40. The fuel amount V flowing to the high-pressure return passage 40 represents an accumulated amount of the fuel that flows in the high-pressure return passage 40. In other words, the ECU 60 determines whether the excess fuel fills the high-pressure return passage 40 in step S500.

If the fuel amount V flowing to the high-pressure return passage 40 simply becomes equal to the high-pressure return passage volume V0, part of condensed water may persistently remain on an inner wall of the high-pressure return passage 40 and in the high-pressure return passage. As the filling period T3 is set longer, an effect that the fuel flowing to the high-pressure return passage 40 pushes out the condensed water from the high-pressure return passage 40 becomes improved. However, increase of the filling period T3 increases power consumption of the feed pump 11. Therefore, the filling period T3 is set with considering the power consumption and the effect of pushing out the condensed water.

If the execution period of the high-pressure return process is shorter than the filling period T3, that is, if the determination of step S500 is negative, the ECU 60 returns to step S400 and continues the high-pressure return process.

If the execution period of the high-pressure return process is the filling period T3 or longer, that is, if the determination of step S500 is affirmative, the ECU 60 proceeds to step S600 and stops the feed pump 11 to terminate the forced return process.

On the other hand, if the ECU 60 determines that the residual fuel remains in the high-pressure return passage 40 in step S200, that is, if the determination of step S200 is negative, the ECU 60 does not execute the forced return process. In other words, the ECU 60 skips steps S300 to 500 and stops the feed pump 11 in step S600.

Figure 4:
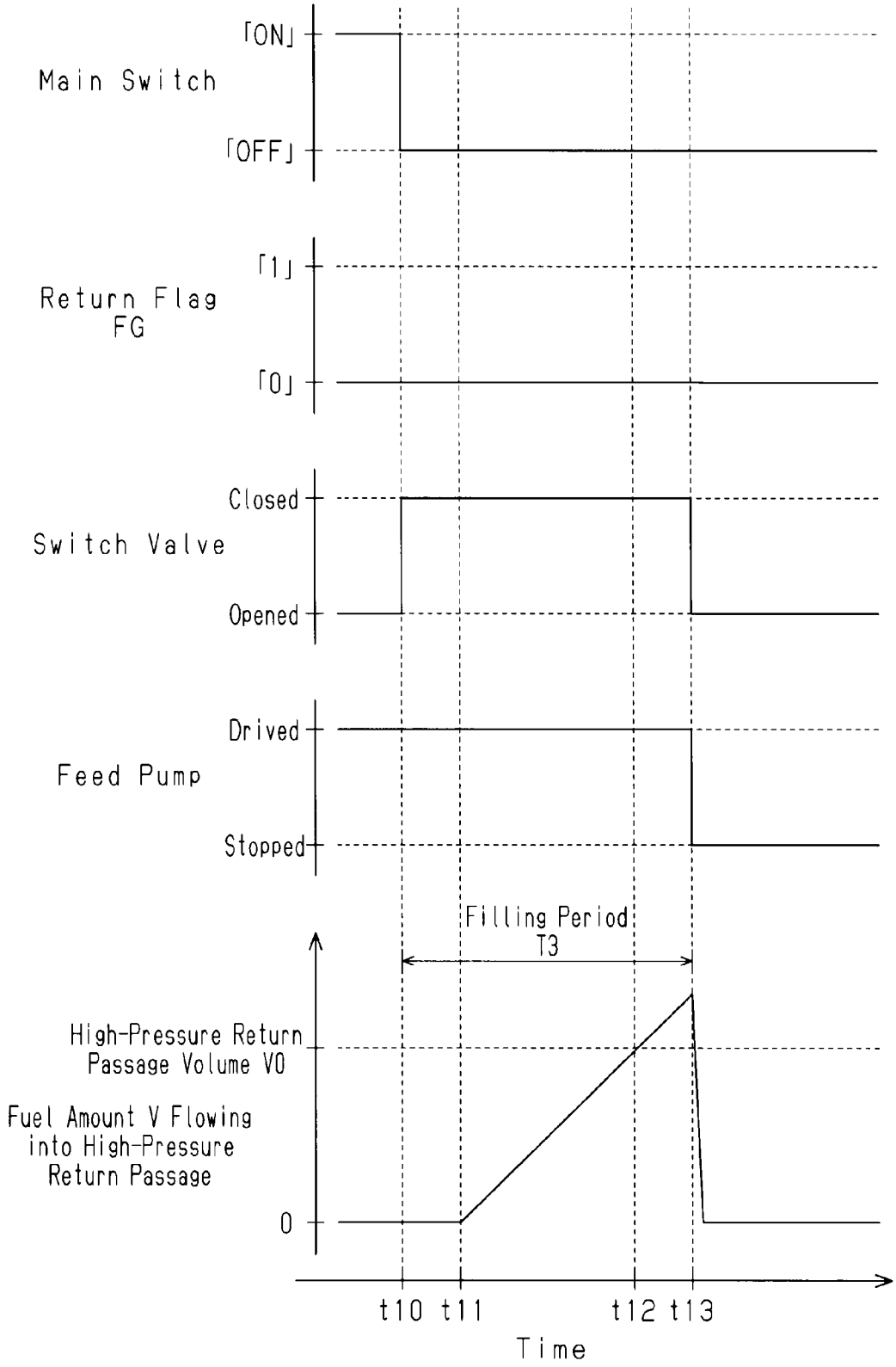
FIG. 4 is a timing chart of a concrete example of the forced return process of FIG. 2.

FIG. 4 is a timing chart of an example of the forced return process. Before time point t10, it is assumed that the main switch 61 is ON, the return flag FG is "0", the switch valve 52 is open, and the feed pump 11 is driven.

At time point t10, when the ECU 60 recognizes that the main switch 61 has been operated to be OFF from ON, the ECU 60 refers to the return flag FG. Since the return flag FG is "0", the ECU 60 executes the forced return process at time point t10. In other words, the ECU 60 closes the switch valve 52 and continuously drives the feed pump 11. As a result, the fuel pressure in the delivery pipe 30 is increased.

At time point t11, if the fuel pressure in the delivery pipe 30 reaches the high-pressure threshold value P1, the high-pressure regulator 41 is opened and the excess fuel in the delivery pipe 30 starts to flow into the high-pressure return passage 40. At time point t12, the high-pressure return passage 40 is filled with the excess fuel. The ECU 60 further continuously drives the feed pump 11 such that the fuel amount V flowing into the high-pressure return passage 40 exceeds the high-pressure return passage volume V0 and continues to increase.

At time point t13, when the ECU 60 determines that the filling period T3 has passed after the main switch 61 is turned off, the ECU 60 stops the feed pump 11. In other words, the forced return process is terminated.

As the forced return process is terminated, the ECU 60 disconnects the switch valve 52 at time point t13. Accordingly, the switch valve 52 is opened. Power supply to the ECU 60 is stopped.

The present embodiment has following advantages.

(1) The ECU 60 executes the forced return process after the engine is stopped so as to flow the fuel into the high-pressure return passage 40. Accordingly, the condensed water stored in the high-pressure return passage 40 is discharged to the fuel tank 10 and the air containing water is also discharged from the high-pressure return passage 40. After the forced return process, that is, after the feed pump 11 is stopped, the fuel remains in the high-pressure return passage 40. Accordingly, the amount of air entering the high-pressure return passage 40 is reduced and the amount of the condensed water generated in the high-pressure return passage 40 while the engine is stopped is reduced. This suppresses the condensed water from being frozen while the engine is stopped to close the high-pressure return passage 40.

(2) If the ECU 60 determines that the fuel amount V flowing into the high-pressure return passage 40 by the forced return process is the high-pressure return passage volume V0 or more, it is determined that the air and the condensed water are discharged from the high-pressure return passage 40. Therefore, the time for terminating the forced return process is easily recognized.

(3) The ECU 60 determines that the fuel amount V flowing into the high-pressure return passage 40 is the high-pressure return passage volume V0 or more if the driving time of the feed pump 11 by the forced return process is the filling period T3 or longer. Therefore, the time for terminating the forced return process is easily obtained. The accumulated amount of the fuel discharged by the feed pump 11 is proportional to the driving time of the feed pump 11.

(4) The ECU 60 sets the return flag FG basically based on the operation history of the switch valve 52 while the engine is running. Therefore, the forced return process is executed so as to reliably prevent water stored in the high-pressure return passage 40 from being frozen.

(5) The ECU 60 sets the return flag FG to "0" if the switch valve 52 is continuously opened for the evaporation period T2 or longer. Therefore, if the residual fuel in the high-pressure return passage 40 evaporates, the high-pressure return passage 40 is filled with fuel.

If determining that the engine temperature TQ is the high-temperature threshold value X or higher, the ECU 60 sets the return flag FG to "0" even if the switch valve 52 is closed. In other words, the ECU 60 invalidates the return flag FG that is set based on the operation history of the switch valve 52 and resets the return flag to "0". Therefore, the high-pressure return passage 40 is filled with fuel in a case where the residual fuel in the high-pressure return passage 40 is highly likely to evaporate due to the high engine temperature TQ.

The above embodiment may be modified as follows.

The manner in which the return flag FG is set may be modified. The return flag FG may be set in another method as long as it can be determined whether the residual fuel remains in the high-pressure return passage 40. For example, as the engine temperature TQ increases, the evaporation period T2 may be shortened. That is, the return flag FG is not necessarily set to be "0" when the engine temperature TQ is the high-temperature threshold value X or higher.

Even if the engine temperature TQ exceeds the high-temperature threshold value X, the return flag FG may be remained to be "1". However, the return flag FG is preferably set to be "0".

The pressure-increasing period T1 and the evaporation period T2 may be omitted. However, these periods T1 and T2 are preferably used. In a case where the pressure-increasing period T1 and the evaporation period T2 are omitted, the ECU 60 sets the return flag FG to "1" when the switch valve 52 is in a closed state while the engine is running, and the ECU 60 sets the return flag FG to "0" when the switch valve 52 is in an open state. The ECU 60 may estimate whether the residual fuel is in the high-pressure return passage 40 by determining the state of the return flag FG while the engine is stopped.

The forced return process may be executed every time the engine is stopped. In other words, step S200 in FIG. 2 may be omitted and the process may proceed to step S300 from step S100. That is, the return flag FG may be set regardless of the state of the switch valve 52.

When the battery voltage that is supplied to the feed pump 11 changes, the discharge amount of the feed pump 11 per unit time is slightly changed. The ECU 60 may control the length of the pressure-increasing period T1 and the filling period T3 based on the change of the battery voltage or the environmental temperature that affects the battery voltage. For example, as the battery voltage or the environmental temperature is lower, the pressure-increasing period T1 and the filling period T3 may be set to be greater.

The forced return process do not need to be executed continuously until the fuel amount flowing into the high-pressure return passage 40 becomes the high-pressure return passage volume V0 or more. Even if the fuel amount flowing into the high-pressure return passage is slightly smaller than the high-pressure return passage volume V0, the condensed water or the air containing water can be pushed out from the high-pressure return passage 40 and the air entering the high-pressure return passage 40 can be reduced.

The execution timing of the forced return process is not necessarily immediately after the engine is stopped. In other words, the determination of step S200 is not necessarily executed immediately after the engine is stopped. The forced return process may be executed after a predetermined time is passed after the engine is stopped. The forced return process is necessarily executed before the high-pressure return passage 40 is cooled down. If the period from the time when the engine is stopped to the forced return execution time is too long, the condensed water may be generated or frozen.

The vehicle in which the fuel supply system of the present invention is mounted is not limited to a flexible-fuel vehicles, but may be a vehicle that runs only with gasoline.

The engine does not need to be a V-type eight cylinder engine, but may be a four cylinder or six cylinder engine.

The invention claimed is:

1. A fuel supply system for supplying fuel to an internal combustion engine, the fuel supply system comprising:

a fuel tank;

a delivery pipe connected to an injector that injects fuel to the engine;

a main passage that extends to the delivery pipe from the fuel tank;

a fuel pump that is provided on the main passage and pressurizes and sends the fuel in the fuel tank to the delivery pipe;

a high-pressure return passage that returns excess fuel in the delivery pipe to the fuel tank;

a high-pressure regulator that opens the high-pressure return passage when fuel injection pressure in the delivery pipe is a high-pressure threshold value or higher, wherein the high-pressure return passage has an upstream end, a downstream end, and a vertically lower portion, and the upstream end is connected to the delivery pipe via the high-pressure regulator, the downstream end is connected to the fuel tank, and the vertically lower portion is vertically below the upstream end and the downstream end;

a low-pressure return passage that returns excess fuel in the main passage to the fuel tank and is connected to the main passage;

a low-pressure regulator that opens the low-pressure return passage when the fuel injection pressure is a low-pressure threshold value or higher, wherein the low-pressure threshold value is lower than the high-pressure threshold value;

a switch valve that switches an open state and a closed state of the low-pressure return passage; and a control section that controls the fuel pump, the control section controlling the fuel injection pressure by switching the open state and the closed state of the switch valve based on a running state of the engine, wherein, after the engine is stopped, the control section switches the switch valve to the closed state and drives the fuel pump so as to execute a forced return process to cause the fuel to flow into the high-pressure return passage, wherein the control section calculates an accumulated amount of fuel that flows into the high-pressure return passage by the forced return process, and wherein, when determining that the accumulated amount has become a volume of the high-pressure return passage or more, the control section terminates the forced return process.

2. The fuel supply system according to claim 1, wherein the control section applies a rated voltage to the fuel pump such that the fuel pump discharges a constant amount of fuel with a constant pressure per unit time, and wherein, when determining that continuous driving time of the fuel pump has become a predetermined period or more while the switch valve is in the closed state by the forced return process, the control section determines that the accumulated amount has become the volume of the high-pressure return passage or more.

3. The fuel supply system according to claim 1, wherein the control section switches the switch valve to the closed state when the control section determines that a large amount of fuel is required due to a high engine load.

4. The fuel supply system according to claim 1, wherein the control section switches the switch valve to the open state when the engine is in a normal operating state, such that the fuel injection pressure in the delivery pipe is maintained by the low pressure regulator and fuel ceases to flow through the high-pressure return passage.

5. A fuel supply system for supplying fuel to an internal combustion engine, the fuel supply system comprising:

a fuel tank;

a delivery pipe connected to an injector that injects fuel to the engine;

a main passage that extends to the delivery pipe from the fuel tank;

a fuel pump that is provided on the main passage and pressurizes and sends the fuel in the fuel tank to the delivery pipe;

a high-pressure return passage that returns excess fuel in the delivery pipe to the fuel tank;

a high-pressure regulator that opens the high-pressure return passage when fuel injection pressure in the delivery pipe is a high-pressure threshold value or higher, wherein the high-pressure return passage has an upstream end, a downstream end, and a vertically lower portion, and the upstream end is connected to the delivery pipe via the high-pressure regulator, the downstream end is connected to the fuel tank, and the vertically lower portion is vertically below the upstream end and the downstream end;

a low-pressure return passage that returns excess fuel in the main passage to the fuel tank and is connected to the main passage;

a low-pressure regulator that opens the low-pressure return passage when the fuel injection pressure is a low-pressure threshold value or higher, wherein the low-pressure threshold value is lower than the high-pressure threshold value;

a switch valve that switches an open state and a closed state of the low-pressure return passage;

a control section that controls the fuel pump, the control section controlling the fuel injection pressure by switching the open state and the closed state of the switch valve based on a running state of the engine, wherein, after the engine is stopped, the control section switches the switch valve to the closed state and drives the fuel pump so as to execute a forced return process to cause the fuel to flow into the high-pressure return passage; and a determining section that determines whether residual fuel remains in the high-pressure return passage based on an operation history of the switch valve while the engine is running, wherein the control section executes the forced return process when determining that no residual fuel is in the high-pressure return passage when the engine is stopped.

6. The fuel supply system according to claim 5, wherein the determining section has a memory for storing information values and sets the information values to a first state value or a second state value, wherein the first state value is set when the switch valve is in the closed state while the engine is running and the excess fuel passes through the high-pressure return passage to be returned to the fuel tank, wherein the second state value is set when the switch valve is in the open state while the engine is running and a state where the excess fuel is returned to the fuel tank without passing through the high-pressure return passage has continued for a predetermined period, and wherein the determining section determines that no residual fuel is in the high-pressure return passage when determining that the information value is the second state value when the engine is stopped.

7. The fuel supply system according to claim 6, wherein the determining section determines that combustion heat of the engine is a predetermined value or greater based on the running state of the engine, and wherein, when determining that the combustion heat of the engine is the predetermined value or greater, the determining section invalidates the setting of the information values that are based on an open/close history of the switch valve, and sets the information value to the second state value.

8. The fuel supply system according to claim 5, wherein when the control section determines that condensed water and air containing water is discharged from the high-pressure return passage into the fuel tank, the control section terminates the forced return process.

* * * * *